US006443429B1

(12) United States Patent
Hawk et al.

(10) Patent No.: US 6,443,429 B1
(45) Date of Patent: Sep. 3, 2002

(54) SURFACE MOUNTED VEHICLE LIFT

(76) Inventors: Marion N. Hawk, 6304 N. Askew, Gladstone, MO (US) 64119; Frederick G. Heath, 3316 Springcrest Dr., Louisville, KY (US) 40241

( * ) Notice: Subject to any disclaimer, the term of this patent is extended or adjusted under 35 U.S.C. 154(b) by 0 days.

(21) Appl. No.: 09/716,593

(22) Filed: Nov. 20, 2000

(51) Int. Cl.[7] ..... B66F 7/12
(52) U.S. Cl. ..... 254/90; 254/10 R; 254/89 H
(58) Field of Search ..... 254/90, 89 H, 254/89 R, 8 R, 8 B, 8 C, 9 R, 9 B, 9 C, 10 R, 10 B, 10 C, 124, 122; 187/8.41, 8.72

(56) References Cited

U.S. PATENT DOCUMENTS 4,848,732 A 7/1989 Rossato
5,040,637 A 8/1991 Hawk
5,050,844 A 9/1991 Hawk
5,096,159 A 3/1992 Fletcher
5,190,122 A 3/1993 Fletcher
5,199,686 A 4/1993 Fletcher

*Primary Examiner*—Robert C. Watson
(74) *Attorney, Agent, or Firm*—Charles G. Lamb; Middleton Reutlinger

(57) ABSTRACT

A surface supported vehicle lift includes at least one independent elevating runway member which accepts loads of varying weights. The runway member accepts uniform or non-uniform loads imposed from a first end to a second end. The runway member includes at least two lift leg assemblies. The lift leg assemblies include hydraulic cylinders and a pump having an electric motor to drive the hydraulic cylinders. Each lift leg assembly also includes pulsed or proportional solenoid valves and position sensors affixed thereto. Synchronizer pumps are provided to equalize flow to and from each lift leg assembly for the runway member, and each lift leg assembly includes pulsed or proportional flow divider bias thereby maintaining lateral and longitudinal synchronization between each lift leg assembly. The surface mounted vehicle lift need not be fixedly attached to a supporting surface, and in addition, may be in moveable contact with the supporting surface. As desired, a guiding means for provision of a specified elevation path may be provided.

19 Claims, 5 Drawing Sheets

SURFACE MOUNTED VEHICLE LIFT

FIELD OF INVENTION

This invention relates to load elevating machines and more particularly to load elevating machines employing pivoting leg elements and hydraulic cylinders as the elevating means.

BACKGROUND OF THE INVENTION

The prior art teaches load elevating machines which use parallel longitudinal platforms fitted with hydraulic cylinder powered articulating legs whereby a vehicle or load may be positioned on the platforms of the lift and then be elevated to a desired level above the supporting floor. When two or more platforms are used, one platform, two or more lift legs, and a base element act as a kinematic assembly to elevate and support one side of a load, and a second assembly supports an opposed side of the load. The prior art is generally directed to machines which exploit a fundamental design feature of parallelogram linkages, which are also known as classic four bar mechanisms. This fundamental design feature results in an elevating motion of upper horizontal links (the load bearing platforms) which necessarily comprises concurrent vertical and horizontal translation of the upper horizontal links. The loads elevated may induce significant tensile or compressive loads in both upper and lower horizontal links, the platforms and bases, respectively. The bases may be discrete structural members, or alternatively, employ a substrate supporting the machine as the required base structural element by suitable mechanical attachment of the lift legs to the supporting substrate.

For conditions of non-uniform platform loading at or below the uniformly distributed load rated lifting capacity of a given platform, parallelogram machines necessarily develop and transmit longitudinal forces in the platform and the base structures. This characteristic is the underlying reason that parallelogram lifts may sometimes lift a runway-rated-load independent of the distribution of the load along the platform length. Dependent on the direction of rotation of the lifting legs with respect to the location of the center of gravity location, and also dependent upon the magnitude of the non-uniform load with respect to the lifting leg platform pivot points, the longitudinal stress resulting from this effect is tensile in one structure and compressive in the other. Parallelogram machines develop maximum cylinder pressure, and thus maximum cylinder rod force, at the beginning of elevation from the lowered position.

Typically, the lift leg hydraulic cylinders of parallelogram lifts operate at a mechanical disadvantage of about ten to one with respect to the vertical loading as a result of the height restrictions of the lowered platform.

For example, a particular platform lift leg pivot point of a two leg platform assembly that is loaded to a design maximum platform capacity of, for example, 20,000 pounds, and that the other platform lift leg pivot point is not loaded, the loaded arm cylinder can supply 10,000 pounds force of the design lift effort (50% of platform lifting capacity). However, to do so, the loaded arm cylinder must develop a cylinder force of ten times the platform lifting force. In this example, the cylinder rod force required is thus 100,000 pounds. Furthermore, the cylinders of the platform are hydraulically connected in parallel. Therefore, the unloaded cylinder must be at the same pressure as the loaded cylinder, and accordingly will also generate a rod force of 100,000 pounds. At the same mechanical disadvantage, this rod force would result in an elevating force of 10,000 pounds, and the 20,000 total platform load capacity would be provided, but the lifting force of the unloaded leg must be transmitted to the loaded leg.

When rod forces are applied, a reacting force to the unloaded leg cylinder force must be transmitted along the platform structure to the loaded leg to provide an additional loaded leg rotation couple. By first principles of statics and dynamics, this couple requires in an equal but opposite-in-direction force in the base structure to maintain the necessary force equilibrium. For the lift leg geometry described, the platform and base structure longitudinal forces are essentially the cylinder-rod-generated force of 100,000 pounds. Thus a two lifting leg platform assembly rated at 20,000 pounds design capacity can have non-intuitive longitudinal forces of 100,000 pounds, or five times the design lifting capacity of the structure.

A physical manifestation of the possible large hidden forces inherent in parallelogram lifts for non-uniform platform loadings is de-synchronization of one or both of the platform lifting legs. If the two parallel platforms of a parallelogram lift are also laterally non-uniformly loaded, then the lift leg pair(s) without control system regulation will contribute additional lateral inclination of the platform support plane. Installation of additional lift leg lateral pair synchronization controls would appear to correct this undesirable development, but to do so essentially reduces the capacity of the entire parallelogram lift to the capacity of a single lifting leg. This limitation occurs because the most loaded lift leg then establishes the maximum differential height of any other lifting leg, and the surplus lift capacity of other legs cannot be transferred to the over loaded leg. There are additional significant parallelogram lift design factors, including mechanical instability, hydraulic instability and platform loading transfers due to the center of gravity migration of a canted three dimensional load which were excluded in this discussion. These factors in general contribute further adverse effects, and do not beneficially alter the characterization of parallelogram lifts.

U.S. Pat. No. 4,848,732 to Rossato teaches a medium range capacity parallelogram machine with runway mounted cylinders and cylinder engaging latches and a passive control system. A laterally adjacent lift leg pair is connected by a torque tube between a pair of parallel base members. A predetermined torsional deflection of the torque tube actuates a switch which immobilizes the lift. Manual control procedures are employed to restore acceptable lateral synchronization of the lift legs and to reactivate the lift.

U.S. Pat. No. 5,040,637 to Hawk teaches a low range capacity parallelogram machine with a single cylinder and a cylinder independent latching load path with automatic latching at ascent. Unlatching is accomplished by a deliberate small elevation of the lift platform prior to lowering.

U.S. Pat. No. 5,050,844 to Hawk teaches a medium to high range capacity parallelogram machine with base mounted cylinders and an active, interlocked and control panel enunciated automatic control system. Lifting leg angular position synchronization is accomplished by detection of lifting leg differential angular position, processing of the detected error with a logic algorithm and resultant modulation of flow to the hydraulic cylinders of the lifting legs to correct the detected error.

U.S. Pat. Nos. 5,096,159; 5,190,122; and 5,199,686 to Fletcher, teach a medium to high range capacity parallelogram machine with runway mounted cylinders and an active automatic control system. Lift leg angular position synchronization is obtained by detection of differential lifting leg cylinder extension position, with logic processing and modulation of flow to the hydraulic cylinders of the lifting legs to correct the detected error. The lift equipment installation supporting substrate is employed as the necessary base element by structural attachment of each lifting leg lower pivot plate into that substrate.

Parallelogram machines have inherent limitations that become intractable for specified non-uniformly distributed loads with arbitrary and non-symmetrical runway loading point locations. Thus, there is a need for a surface mounted vehicle lift which overcomes the inherent limitations of known parallelogram machines.

SUMMARY OF THE INVENTION

The present invention is directed to hydraulic cylinder powered lift leg assemblies used for elevating and lowering of parallel runway members when two or more runway members are used. However, the present invention is not a parallelogram machine in that no structural base element is employed. This fundamental kinematic difference results in a machine that is different in kind, as opposed to degree, to a parallelogram (four bar mechanism) machine.

An object of the present invention is to provide a surface supported vehicle lift which includes load elevation and lowering in a desirably improved and more adaptable manner while maintaining predictable capacity to specified non-uniform and non-symmetrical loading.

Another object of the present invention is to provide a surface supported vehicle lift including at least one runway member which is fitted with lateral platform axis pivoted lift leg assemblies.

A further object of the present invention is to provide a surface supported vehicle lift including two lateral runway members, each lateral runway member having an axis pivoted lift leg assembly selectively power controlled to position the runway member in a preselected manner.

Even another object of the present invention is to provide a surface supported vehicle lift including at least two lateral runway members, each runway member having a pivoted lift leg assembly instrumented to permit determination of relative or absolute position of the runway member lateral pivot axis in relation to fixed or variable selected reference data.

Also, a further object of the present invention is to provide a surface supported vehicle lift wherein the opposite end of a lift leg assembly pivots from a runway member and bears on a supporting surface.

Even a further object of the present invention is to provide a surface supported vehicle lift including a surface bearing leg end being alternatively configured to:

(a) rock on a supporting surface in a manner determined by the effective radii of a contacting leg end and an extending position of the lift leg assembly; or, (b) rotate about an axis established by a substrate supported bearing;

(c) roll on a substrate; or, (d) any or all of the above on a pad provided to control the unit load on a supporting substrate.

More particularly, a surface mounted vehicle lift includes a plurality of runway members which may be selectively elevated and lowered relative to the supporting surface by lift leg assemblies through suitable controls on an operating console.

The supporting surface includes a ramp portion disposed at one end of a runway member, or, alternatively, at both ends for a drive-through arrangement. Each runway member has an interior cavity adapted to receive lift leg assemblies for elevating the runway member relative to the supporting surface. The lift leg assemblies are pivotably received in interior cavities of the runway members and operate in tandem.

The upper end of each lift leg assembly comprises an upper transverse shaft which is pivotally connected at one end to the runway member. The other, lower end of each lift leg assembly rests and rocks upon the supporting surface. Preferably, each lift leg assembly is defined by first, second and third parallel members that are maintained in a spaced relation by an upper and lower transverse shaft. A rod end is secured to a transverse cylinder pivotal shaft of a fluid cylinder fitted to the lift leg assembly. The head end of the fluid cylinder is opposite the rod end, and is additionally pivotably secured to the runway member through a transverse head end pivotal shaft. Selective extension of the fluid cylinder rod moves the lift leg assembly outwardly from the platform member. Selective retraction of the fluid cylinder rod moves the lift leg assembly inwardly until disposed within the runway cavity.

BRIEF DESCRIPTION OF THE DRAWINGS

A better understanding of the invention will be had upon reference to the following description in conjunction with the accompanying drawings in which like numerals refer to like parts throughout the several views and wherein.

DESCRIPTION OF THE PREFERRED EMBODIMENT

Figure 1:
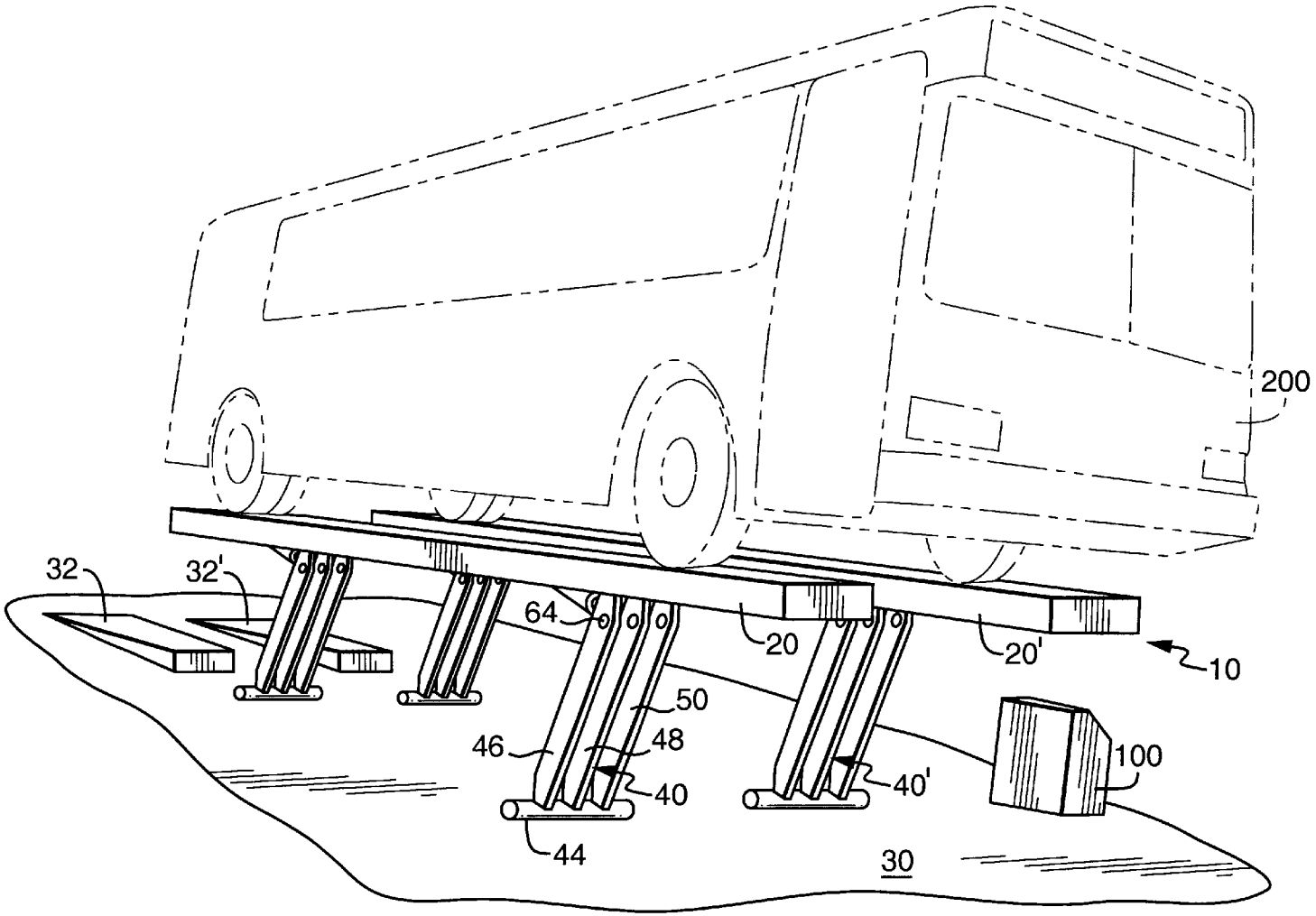
FIG. 1 is a perspective view of a surface mounted vehicle lift of the present invention in a first lifting position.
Figure 2A:
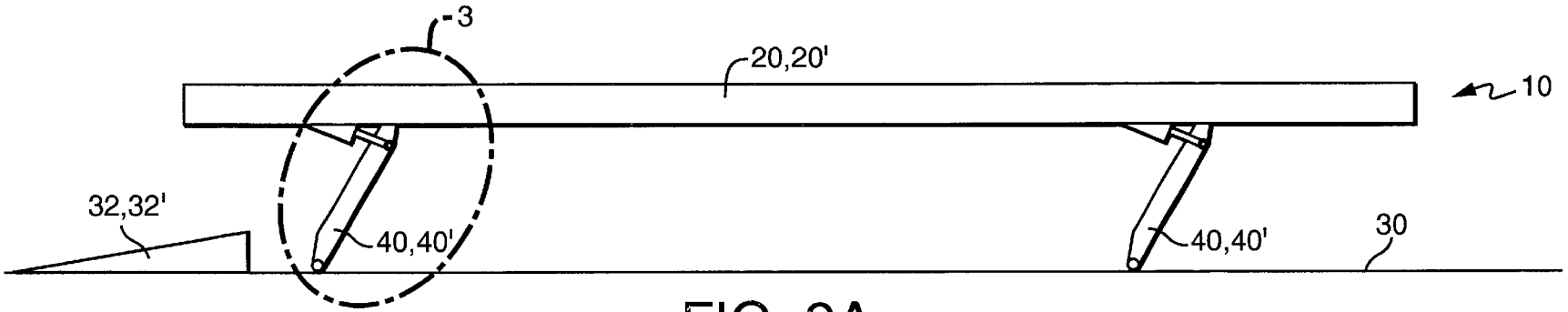
FIG. 2*a* is a side view of the present invention in a raised position.
Figure 2B:
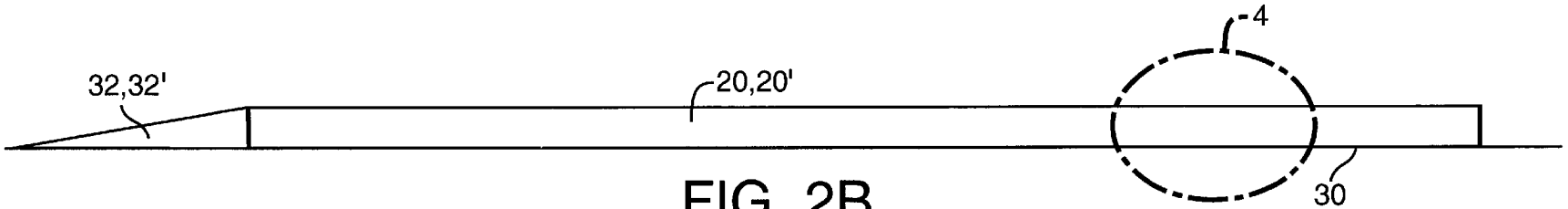
FIG. 2*b* is a side view of the present invention in a lowered position.

In the Figs. is illustrated a surface mounted vehicle lift 10 which is adapted to support a load such as a large vehicle 200. The surface mounted vehicle lift 10 includes at least one runway member 20, and preferably two runway members 20 which may be selectively elevated and lowered relative to the supporting surface 30 by lift leg assemblies 40 through suitable controls on an operating console 100.

FIGS. 1 and 2*a*–4 show that the supporting surface 30 includes ramp portions 32 disposed at one end of a runway member 20 or, alternatively, at both ends for a drive-through arrangement. Each runway member 20 has an interior cavity adapted to receive lift leg assemblies 40 for elevating the runway member 20 relative to the supporting surface 30.

More particularly, the lift leg assemblies 40 are pivotably received in interior cavities of the runway members 20. And, the lift leg assemblies 40 operate in tandem. For ease of illustration and understanding, the second lift leg assembly 40' and runway member 20' are usually identified with a primed suffix (') to indicate that they are substantially identical to the first lift leg assembly 40 and the first runway member 20.

Figure 3:
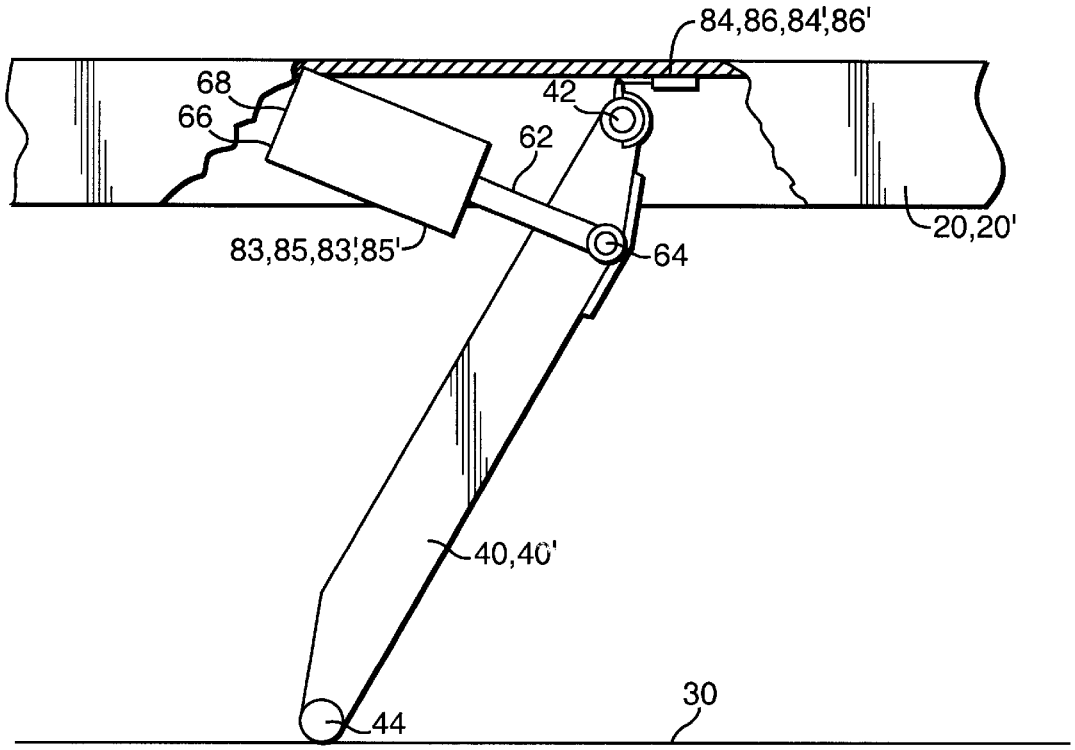
FIG. 3 is an enlarged side view of area 3 of FIG. 2*a* with selected portions cut away to show relevant details.
Figure 4:
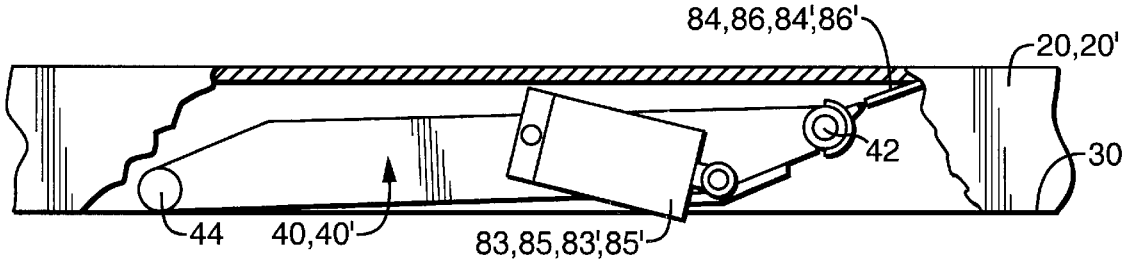
FIG. 4 is an enlarged side view of area 4 of FIG. 2*b* with selected portions cut away to show relevant details.

Referring to FIGS. 1 and 3, the upper end of each lift leg assembly 40 comprises an upper transverse shaft 42 which is pivotally connected at one end to each runway member 20 and 20'. The other, lower, end of each lift leg assembly 40 rests and rocks upon the supporting surface 30. Preferably, each lift leg assembly 40 is defined by first, second and third parallel members, 46, 48, and 50, respectively, that are maintained in a spaced relation by an upper and lower transverse shaft, 42 and 44, respectively.

With particular reference to FIG. 3, a fluid cylinder rod 62 is secured to a transverse cylinder pivotal shaft 64 of a fluid cylinder 83, 85, 83', 85' fitted to the lift leg assembly 40. The head end 66 of the fluid cylinders 83, 85, 83', 85', is opposite the rod end 62, and is additionally pivotably secured to the runway members 20 and 20' through a transverse head end pivotal shaft 68. Selective extension of the fluid cylinder rod 62 moves the lift leg assembly 40 outwardly from the platform members 20 and 20'. Selective retraction of the fluid cylinder rod 62 moves the lift leg assembly 40 inwardly until disposed within the runway cavity.

Again, FIG. 3 shows the lift leg assembly 40 lower end transverse shaft 44 as it bears tangentially upon the supporting substrate surface 30.

Figure 6:
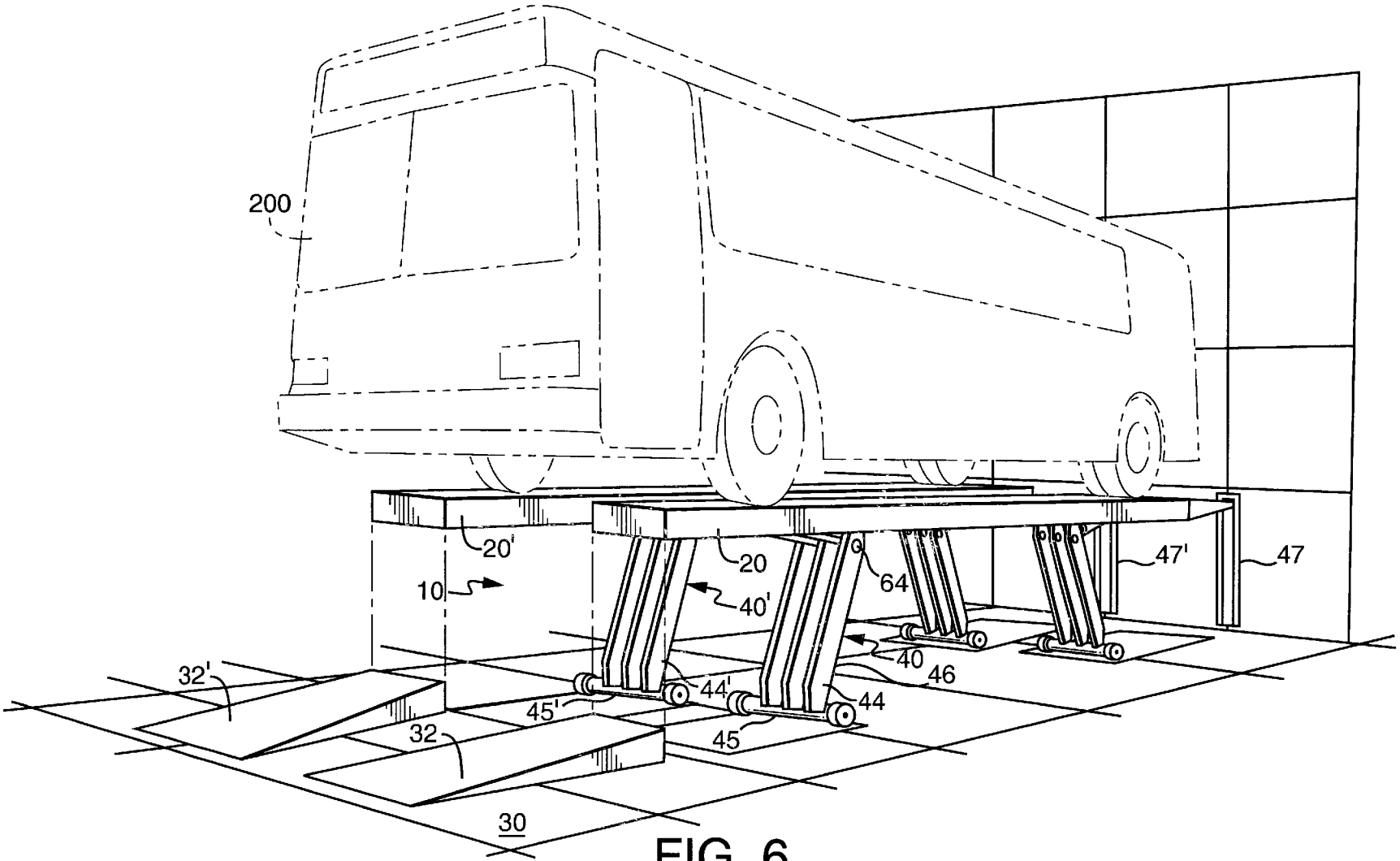
FIG. 6 is a perspective view of the lift of FIG. 1 in a second lifting position.

Referring back to FIG. 1 and to FIG. 6, the opposite end of a lift leg assembly 40 pivoting from the runway members 20 and 20' bears on a supporting surface 30. The surface 30 bearing end of the lift leg assembly 40 may be alternatively configured to:

(a) rock on a supporting surface 30 in a manner determined by the effective radii of the contacting leg end and the extending angular position of the lift leg assembly 40;

(b) roll on the supporting surface 30 by means of a freely rotating lower end transverse shaft 44 mounted roller 45 of the lift leg assembly 40 that is not dependent on the position of the lift leg assembly 40; or, (c) rotate about an axis established by a substrate supported bearing (not shown).

If rolling contact by rollers 45 upon the supporting surface 30, is employed for each lift leg assembly 40, then longitudinal restraining means for the resulting relatively low and predictable force magnitudes may be applied to the runway members 20 and 20' with elevation path guidance 47, thereby achieving runway member 20 and 20' with elevation and descent in motion that is purely vertical, or guided as otherwise desired. If lift leg assembly 40 with roller 45, 45' substrate 30 contact is employed and elevation path guidance 47, 47' is applied to the runway members 20 and 20', then the lift leg assemblies 40, 40' can be electively and independently disposed in the direction of articulation rotation as shown in FIG. 6.

If rolling bearing contact upon the supporting surface 30 is employed, the rotational direction of a given lift leg assembly 40 deployment from a runway member 20 and 20' may be the same as, or be in opposition to, any other given lift leg assembly 40 deployment rotational direction.

The prime mover of every lift leg assembly 40 member 46, 48, and 50 of a lift assembly is sized to elevate the most adverse lift leg assembly 40 member 46, 48, and 50 load for a selected nonuniform runway member 20 and 20' load distribution or set.

A given lift leg assembly 40 may have a multiplicity of capacity ratings which correspond to every degree of nonuniform loading selected and may include uniform loading as one such selection.

The motion of elevation of a given runway member 20 and 20' may be any arbitrary path within a runway member 20 and 20' horizontal-vertical plane for which path control is provided, including pure vertical translation.

Figure 5:
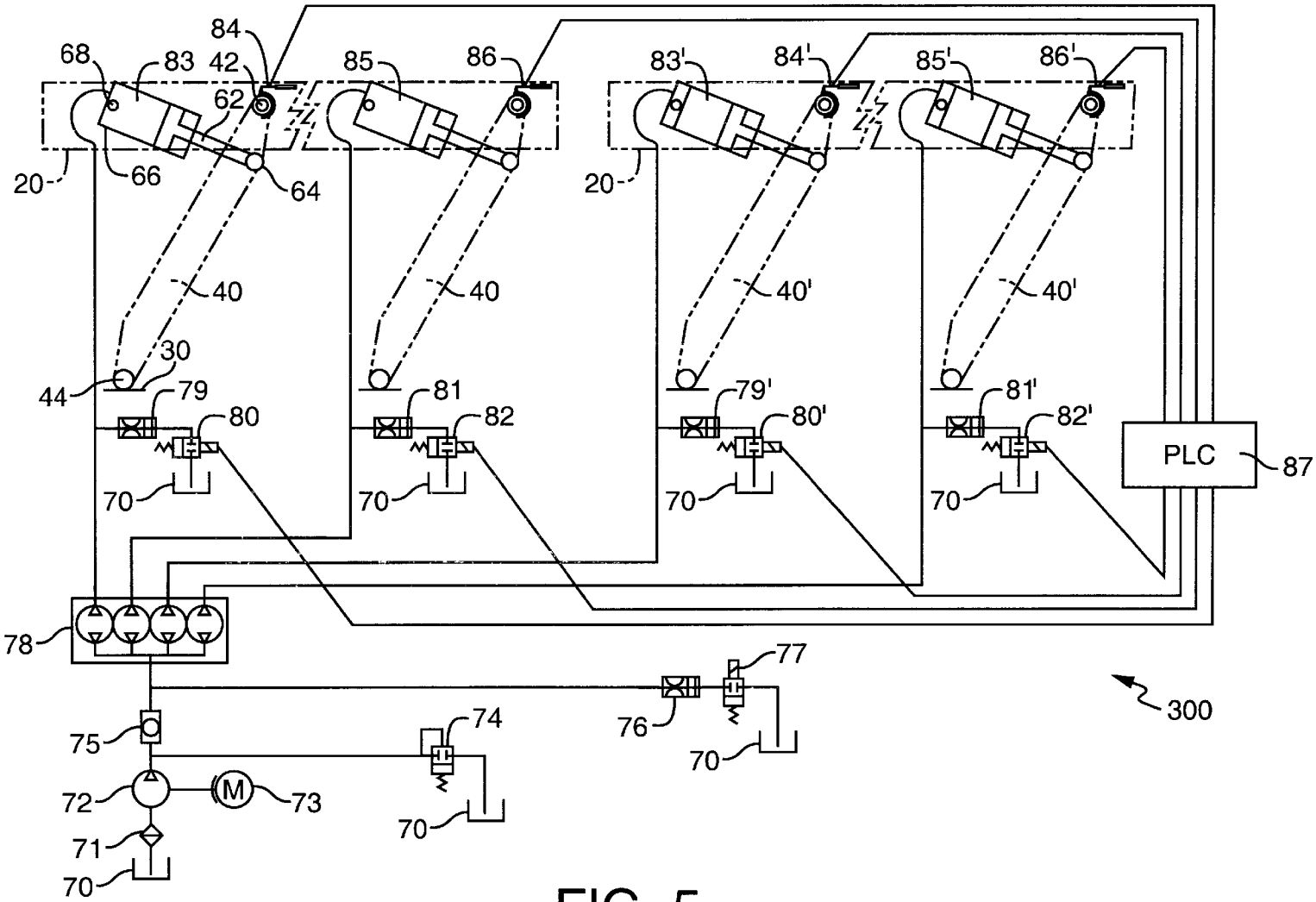
FIG. 5 is a schematic view of a control and operating system for use with a surface mounted vehicle lift of the present invention.

In the operation of the lift 10, a closed loop control system 300 is employed wherein a logic algorithm compares all lifting system platform leg elevations to a desired position, and modulates power to the prime movers to correct runway members 20 and 20' elevation. FIG. 5 shows, for example, a basic schematic diagram of a control system 300 for operation of a preferred embodiment of the present invention.

For an initial operational condition of system power applied and the runway members 20 and 20' stationary in a lowered position, the nomenclature and state of the control system components is hydraulic fluid reservoir 70 full, pump suction filter 71 filled, electric motor 73 off, main pump 72 stationary, isolation check valve 75 closed, pressure relief valve 74 closed, descend valve 77 closed, descend flow controller 76 inactive, synchronizer pumps 78 stationary, solenoid valves 80, 82, 80', 82' closed, trim flow controllers 79, 81, 79', 81' inactive, lift leg assembly hydraulic actuator piston rods 62 of fluid cylinders 83, 85, 83', 85' retracted, runway member position sensors 84, 86, 84', 86' retracted and transmitting equal lowered runway members 20 and 20' position signals, programmable logic controller, abbreviated "PLC", 87 operating and comparing the signals of position sensors 86, 84', and 86' to 84. The signals are processed and determined equal by the programmable logic controller (PLC) 87 and the outputs of the PLC 87 to the solenoid valves 80, 82, 80', 82' are off, and thus the solenoid valves 80, 82, 80', 82' are in the closed position.

Elevation of the runway members 20 and 20' is begun by application of electrical power to the electric motor 73 and the resulting main pump 72 rotation will provide flow to the hydraulic system. For rated runway members 20 and 20' loads, the hydraulic pressure developed is below the set point of the pressure relief valve 74 which remains closed, and check valve 75 opens. The descend valve 76 is closed and flow is provided to the hydraulically parallel ports of the synchronizer pumps 78. The synchronizer pumps 78 are essentially four equal positive displacement gear pumps connected by an internal common rotating shaft. The hydraulic fluid flow from the main pump 72 through the synchronizer pumps 78 is therefore divided equally in volume and independently in pressure, and metered to the four hydraulically independent ports of the synchronizer 78. The solenoid valves 80, 82, 80', 82' are closed and thus equal hydraulic fluid flow volume is supplied to each of the lift leg assembly hydraulic cylinders 83, 85, 83', 85'. The hydraulic fluid pressure in each cylinder 83, 85, 83', 85' increases until the hydraulic actuator piston rod 62 force developed by the cylinder slightly exceeds the load resistance acting on that cylinder, and runway members 20 and 20' elevation results. The initial runway members 20 and 20' elevating rate is determined by the volumetric output of the main pump 72, and this initial rate will then slowly decrease with increasing runway members 20 and 20' elevation as a result of the change in lift leg assembly 40, 40' and cylinders 83, 85, 83', 85' geometry due to the relative rotations of the lifting lift leg assemblies 40, 40' and cylinders 83, 85, 83', 85'.

The volumetric fluid flow to each cylinder 83, 85, 83', 85' is maintained essentially equal over the short term by a division of the main pump 72 output into four equal volume flows by the synchronizer pumps 78.

At this point, consideration must be given to the fact that a number of effects tend to desynchronize over the long term the position of the hydraulic actuator piston rods 62. Accordingly, the heights of the runway members 20 and 20' are desynchronized over the long term at the lift leg assemblies 40, 40' upper transverse shafts 42. Four common contributors to this desynchronization are: (1) dimensional variations (tolerance and wear) in the kinematic linkage; (2) differing internal leakage of the separate pumps within the synchronizer pumps 78 for various operating pressures; (3) the hydraulic fluid transport of small but differing volumes of air to the cylinders 83, 85, 83', 85'; and, (4) lateral and longitudinal nonuniform runway member 20 and 20' loadings resulting in some degree of deflection to the elastic structures.

The problem of desynchronization is solved by the present invention in that dynamic measurement and correction of relative runway members 20 and 20' heights is accomplished by a runway synchronization trim subsystem. The runway synchronization trim subsystem is illustrated in FIG. 5 as consisting of the runway position sensors 84, 86, 84', 86', the PLC 87, the solenoid valves 80, 82, 80', 82', and the trim flow controllers 79, 81, 79', 81'. Two strategies of runway members 20 and 20' height control are valid, the use of an absolute master lift leg assembly or the use of a relative master lift leg assembly, one being identified by the numeral 40 and the other by numeral 40'. For an absolute master control, a specific runway single lift leg assembly 40 or 40' is defined as the master and all others as slaves.

The optimum selection of the control strategy as absolute or relative is dependent on the detail design parameters of the system. Key factors include: runway members 20 or 20' length; number of lift leg assemblies 40, 40' per runway member 20 or 20'; location of the lift leg assembly 40, 40' on the runway member 20 or 20'; and ratio of maximum rated non-uniform load to maximum rated uniform load, which is selected to result in minimizing the bending stress in the lift leg assembly 40, 40', or the runway members 20 and 20', or both. For either control strategy selected, absolute or relative, the operational result is: The output of a master lift leg assembly 40, 40' runway member 20 or 20' position transducer 84, 84', 86, 86' is compared to the output of a slave lift leg assembly 40 runway member 20 or 20' position transducer 84, 84', 86, 86' and for any runway member 20 or 20' elevation difference greater than a small selected maximum (dead-band) found, the PLC 87 applies and maintains power to the output channel in the PLC 87 for the more elevated runway member 20 and 20' lift leg assembly 40, 40'.

This repetitive comparison process results in the opening of one or more of the solenoid valves 80, 82, 80', 82' for each detected error. The trim flow controllers 79, 81, 79', 81' are each preset to a flow regulation rate of about 20% of the design flow to any given lift leg assembly 40 hydraulic cylinder 83, 85, 83', 85' from the flow division of the synchronizer pumps 78. The opening of the solenoid valve 80, 82, 80', 82' of any more elevated lift leg assembly 40, 40' thus results in a reduction of the flow rate to the hydraulic cylinder of that lift leg assembly 40, 40' and the rate of elevation of that lift leg assembly 40 is reduced by about 20%, permitting the lower elevation lift leg assembly 40 to synchronize with the higher lift leg assembly 40 and thus the elevation error to be corrected, at which time the open solenoid valve 80, 82, 80', or 82' will be closed by PLC 87 removal of power from that lift leg assembly 40's solenoid valve 80, 82, 80', or 82' and the resultant closing of the open solenoid valve 80, 82, 80', or 82'.

For an initial operational condition of system power applied and the runway members 20 and 20' stationary in an elevated position, the state of the components are: Hydraulic fluid reservoir 70 level reduced below full by the fluid displaced to the cylinder extensions, pump suction filter 71 full, electric motor 73 off, main pump 72 stationary, pressure relief valve 74 closed, isolation check valve 75 closed, descend valve 77 closed, descend flow controller 76 inactive, synchronizer pumps 78 stationary, solenoid valves 80, 82, 80', 82' closed, trim flow controllers 79, 81, 79', 81' inactive, lift leg assembly 40 hydraulic cylinders 83, 85, 83', 85' extended, runway position sensors 84, 86, 84', 86' extended and transmitting equal elevation runway position signals, PLC 87 operating and comparing the signals of the position sensors. The signals are processed and determined equal by the programmable logic controller (PLC) 87 and the PLC 87 outputs to the solenoid valves 80, 82, 80', 82' are therefore off, and the solenoid valves 80, 82, 80', 82' are in the closed position.

Descent of the runway members 20 and 20' is begun by application of electric power to open the descend valve 77. The weight of the runway members 20 and 20' and load, if any, acting on the cylinder push rods 62 pressurizes the hydraulic fluid in the cylinders 83, 85, 83', 85', generally at different pressure levels. The resultant flow from each cylinder 83, 85, 83', 85' is to the independent ports of the synchronizer pumps 78. The flow from each cylinder 83, 85, 83', 85' is metered essentially equal by the synchronizer pumps 78 and combined into a uniform pressure flow which maintains the isolation check valve 75 closed. The combined flow from the ports of the synchronizer pumps 78 passes through the preset descend flow controller 76, the open descend valve 77, and into the reservoir 70. The descend flow controller 76 is preset to about 80% of the flow rate of the main pump 72 output to produce descent rates somewhat less than the elevation rates. The trim control strategy selected, absolute or relative master runway elevation sensor output comparison as discussed in the elevation control section, remains in effect. The more elevated runway member 20 and 20' positions are detected by comparison of master and slave runway position sensors 84, 86, 84', 86' by the PLC 87 using a preselected algorithm, and power is applied to those corresponding PLC 87 output channels. The resultant solenoid valve 80, 82, 80', or 82' opening of the more elevated lift leg assembly 40 cylinder 83, 85, 83', or 85' provides an additional regulated flow discharge path for the more extended cylinder(s) 83, 85, 83', or 85'. The trim flow controllers 79, 81, 79', 81' are set (as discussed in the elevation section) to about 20% of the flow provided to each cylinder 83, 85, 83', 85' by the independent port metered flow of the synchronizer pumps 78 during elevation, thus the descending rate of a cylinder 83, 85, 83', or 85' with an open solenoid valve 80, 82, 80', or 82' will be about 20% of the elevation rate due to the corresponding trim flow controller 79, 81, 79', or 81' and an additional 80% of elevation rate due to the descend flow controller 76. The decent rate, therefore, is essentially the same as the elevation rate but may be adjusted if desirable to rates either greater or less than the elevation rate. As in elevating runway member 20 and 20' synchronization control, the descending height error correcting solenoid valve 80, 82, 80', or 82' remains open until the runway error is corrected to the specified dead band, then is closed by PLC 87 detection of the equalized runway position sensor 84, 86, 84', 86' input and resultant closing of that solenoid valve 80, 82, 80', or 82'.

In operation, a vehicle 200 is moved in place upon a vehicle lift 10 which is in a lowered position. The vehicle 200 is then chocked or otherwise held in place on the runway member(s) 20 and 20' of the lift. When lifting is desired, an operator engages a circuit which causes the lift leg assemblies 40 begin to raise the runway member 20 and 20' by force applied from the hydraulic cylinders 83, 85, 83', 85'. As the runway member 20 and 20' elevates the control system ensures that the runway member 20 and 20' remains consistently level and typically horizontal to the supporting surface 30 both from front to rear (longitudinally) and from side to side (laterally). This is accomplished by synchronizing, as described above, the elevation of each lift leg assembly.

The detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A surface supported vehicle lift comprising:

at least one runway member;

at least two spaced lift leg assemblies pivotably affixed to said runway member, each of said at least two lift leg assemblies including at least one parallel member affixed at one end to said runway member by an upper transverse shaft, and a lower transverse shaft in non-fixed contacting relation with a supporting surface;

means for pivoting said lift leg assemblies whereby said at least one runway member is preselectably elevated and lowered; and, a control system including means to elevate or lower said at least one runway member.

2. The surface supported vehicle lift of claim 1, said means for pivoting said lift leg assemblies includes a fluid cylinder with a fluid cylinder rod on one end and a head end on an opposed end, said fluid cylinder rod pivotably joined to said at least one parallel member by a transverse cylinder pivotal shaft, and said head end of said fluid cylinder pivotably joined to said runway member.

3. The surface supported vehicle lift of claim 2, said control system including at least one solenoid valve actively responsive to a position sensor, said position sensor being responsive to a preselected position of said upper transverse shaft, said solenoid valve actuating said fluid cylinder rod.

4. The surface supported vehicle lift of claim 1, said lower transverse shaft being cylindrical whereby said lift leg assemblies are capable of rocking or rolling.

5. The surface mounted vehicle lift of claim 1, said lift leg assembles being positioned on a surface whereby one of said parallel members is in parallel with a second of said parallel members upon elevating and lowering said runway member.

6. The surface mounted vehicle lift of claim 1, said lift leg assemblies being positioned on a surface whereby said at least one of said parallel members is in non-parallel relation with a second of said parallel members upon elevating and lowering said runway member.

7. The surface mounted vehicle lift of claim 1, said at least two lift leg assemblies rollably rotatable in the same direction.

8. The surface mounted vehicle lift of claim 1, said at least two lift leg assemblies rollably rotatable in an opposite direction.

9. The surface mounted vehicle lift of claim 2 having fluid lines connecting a pump to said fluid cylinders, said pump having an electric motor to drive said fluid cylinders.

10. The surface mounted vehicle lift of claim 9 including synchronizer pumps affixed in said fluid lines and in between said pump and said fluid cylinders, whereby fluid flow is equalized to and from each said fluid cylinder.

11. The surface mounted vehicle lift of claim 10, said solenoid valve including a plurality of solenoid valves affixed in said fluid lines and between said synchronizer pumps and each of said fluid cylinders thereby equalizing the position of each said lift leg assembly.

12. The surface mounted vehicle lift of claim 11 including pulsed runway position sensors affixed to each said runway member and adjacent to each said lift leg assembly.

13. The surface mounted vehicle lift of claim 11 including proportional runway position sensors affixed to each said runway member and adjacent to each said lift leg assembly.

14. The surface mounted vehicle lift of claim 11, said control system including a programmable logic controller electrically connected to each said runway position sensor, thereby receiving electrical signals sent from each said runway position sensor to said programmable logic controller, and said programmable logic controller electrically connected to each said solenoid valve and sending electrical signals thereto.

15. The surface mounted vehicle lift of claim 14, said solenoid valve being pulsed.

16. The surface mounted vehicle lift of claim 14, said solenoid valve being proportional.

17. The surface mounted vehicle lift of claim 14, said solenoid valve being opened or closed in response to said electrical signals sent from each said runway position sensor to said programmable logic controller, said signals being compared by said programmable logic controller whereby said solenoid valve is preselectably opened and closed, thereby maintaining said lift leg assemblies positioned to maintain said runway member level.

18. The surface mounted vehicle lift of claim 17, said control system monitoring said runway sensors, whereby any preselected path of motion of both elevation and lowering of said at least one runway member is provided, including purely vertical motion with no horizontal component of said motion.

19. The surface mounted vehicle lift of claim 1, further comprising rollably rotatable contact between said one or more lift leg assemblies and a supporting surface.

* * * * *